US009688515B2

(12) United States Patent
Macareño et al.

(10) Patent No.: US 9,688,515 B2
(45) Date of Patent: Jun. 27, 2017

(54) ELEVATOR CAR DOOR INTERLOCK

(71) Applicants: Ricardo Macareño, Miami, FL (US); Nelson Alonso, Miami, FL (US)

(72) Inventors: Ricardo Macareño, Miami, FL (US); Nelson Alonso, Miami, FL (US)

( * ) Notice: Subject to any disclaimer, the term of this patent is extended or adjusted under 35 U.S.C. 154(b) by 465 days.

(21) Appl. No.: 14/301,869

(22) Filed: Jun. 11, 2014

(65) Prior Publication Data

US 2015/0360911 A1 Dec. 17, 2015

(51) Int. Cl.
*B66B 13/20* (2006.01)

(52) U.S. Cl.
CPC ..... *B66B 13/20* (2013.01)

(58) Field of Classification Search
CPC ..... B66B 13/20; B66B 13/16; B66B 13/28
USPC ..... 187/314, 334, 335
See application file for complete search history.

(56) References Cited

U.S. PATENT DOCUMENTS 520,103 A * 5/1894 Beardsworth ..... B66B 13/20 187/331
579,430 A * 3/1897 Hail ..... B66B 1/08 187/309
593,963 A * 11/1897 Iske ..... B66B 1/08 187/309
1,304,798 A * 5/1919 Mutton ..... B66B 13/20 187/280
1,314,552 A * 9/1919 Wexler ..... B66B 13/02 187/280
1,751,058 A * 3/1930 Rosentreter ..... B66B 13/20 187/321
1,949,788 A * 3/1934 Dunn ..... B66B 13/20 187/283

* cited by examiner

*Primary Examiner* — William E Dondero
*Assistant Examiner* — Diem Tran
(74) *Attorney, Agent, or Firm* — Christian Sanchelima; Jesus Sanchelima

(57) ABSTRACT

An elevator car door interlock including a locking assembly, cable assembly, switch assembly, and top mounting assembly. The elevator car door interlock works in combination with flags installed in an elevator's hoistway. A flag is installed in the areas where it is permitted to open the elevator doors. The locking assembly includes an arm that engages the flag. The flag then prevents the arm from reaching its maximum tilt and keeps it in the substantially vertical position. This causes the hook in the locking assembly to remain in the lowered position. The hook in this position allows the cable to freely travel when the elevator doors are attempted to be open. If the elevator is in a locking zone, then there is no flag present and as the door is attempted to be open, a weighted member attached to the bottom of the cable will begin to rise. However, because no flag is present to hold the arm back and subsequently, keep the hook lowered, an elongated spring biases the hook upwards until it engages a locking pin mounted to the weighted member. This prevent the cable from traveling freely throughout the shaft, thereby keeping the elevator doors locked.

12 Claims, 13 Drawing Sheets

ELEVATOR CAR DOOR INTERLOCK

BACKGROUND OF THE INVENTION

1. Field of the Invention

The present invention relates to an elevator car door interlock.

2. Description of the Related Art

Several designs for elevator car door restrictors have been designed in the past. Many commercially available elevator systems have car door interlocks that require the use of rigidly mounted flags (flags are rigid structures affixed to the sides of the hoistway) along the entire length of the hoistway with predetermined interruptions. None of them, however, include the use of flags to allow the elevator car doors to open. The flags are used to keep the elevator car doors closed except when interrupted in registration with the landings.

A door locking system is disclosed in EP 1,886,963. This system includes the use of a door interlock assembly (16) in each landing (Par. 20). This European reference disclosed a complicated mechanism that requires the use of at least one interlock assembly (16) at each landing.

Alternative elevator car door interlocks rely on the elevator's clutch with several moving parts, which uses pick up rollers. Relying on these rubber pick up rollers is unreliable because they include many small moving parts and are made of rubber, both are easily vulnerable to wear and tear. This requires significant maintenance. The lack of such maintenance typically leads to elevator code violations or breakdowns. Also, these types of restrictors require precise adjustments for them to work, as they require a straight path throughout the hoistway. The present invention can work independently of any clutch that is used and does not rely on the clutch for the restrictor to work. This means that even if the clutch requires maintenance there will not be a violation for a faulty restrictor because the restrictor works independently from the clutch. In addition, the present invention is adjustable and can readily conform to a hoistway that is not entirely straight.

Other designs for elevator car door restrictors include a bar system that is mounted to the inner elevator car door. With these designs the car doors are allowed to open at any portion throughout areas where there are no flags along the hoistway. Thus, numerous flags are required along the hoistway to keep the elevator doors locked. This leads to an added cost in elevator installations and increases the likelihood of a failure due to there being more parts that may fail. Additionally, the bar system makes it more difficult for emergency personnel to open the car doors in case of an emergency because of the challenges associated with reaching the remote bar.

Moreover, the nature of bar system requires the flags that the bar pushes up against to withstand the force of the elevator doors wanting to open. This force requires that the flags be made out of a heavier—and more costly—material. Also, if there are recesses along the hoistway, fascia must be installed to fill the space so that the flag can reach the bar system. This is yet another added expense related to the bar system.

SUMMARY OF THE INVENTION

It is one of the main objects of the present invention to provide an elevator car door interlock system that eliminates the use of flags between landings along a hoistway by only needing flags to open the car door within the unlocking zone, thereby creating a more economic and still reliable solution.

It is another object of this invention to provide a car door interlock system that is compatible with any hoistway and does not require fascia to cover the recesses or setbacks along the hoistway.

It is still another object of the present invention to provide an interlock system that does not rely on a critically straight hoistway as much as a system with pick up rollers.

It is still another object of the present invention to provide an electrical switch that when the arm falls forward causing the hook to engage a locking pin, the doors lock, and the driving means is disabled upon the weighted carriage lifting off the switch so that the elevator stops running when someone attempts to open the elevator door.

It is another object of the invention to provide an interlock system that complies with regulations.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
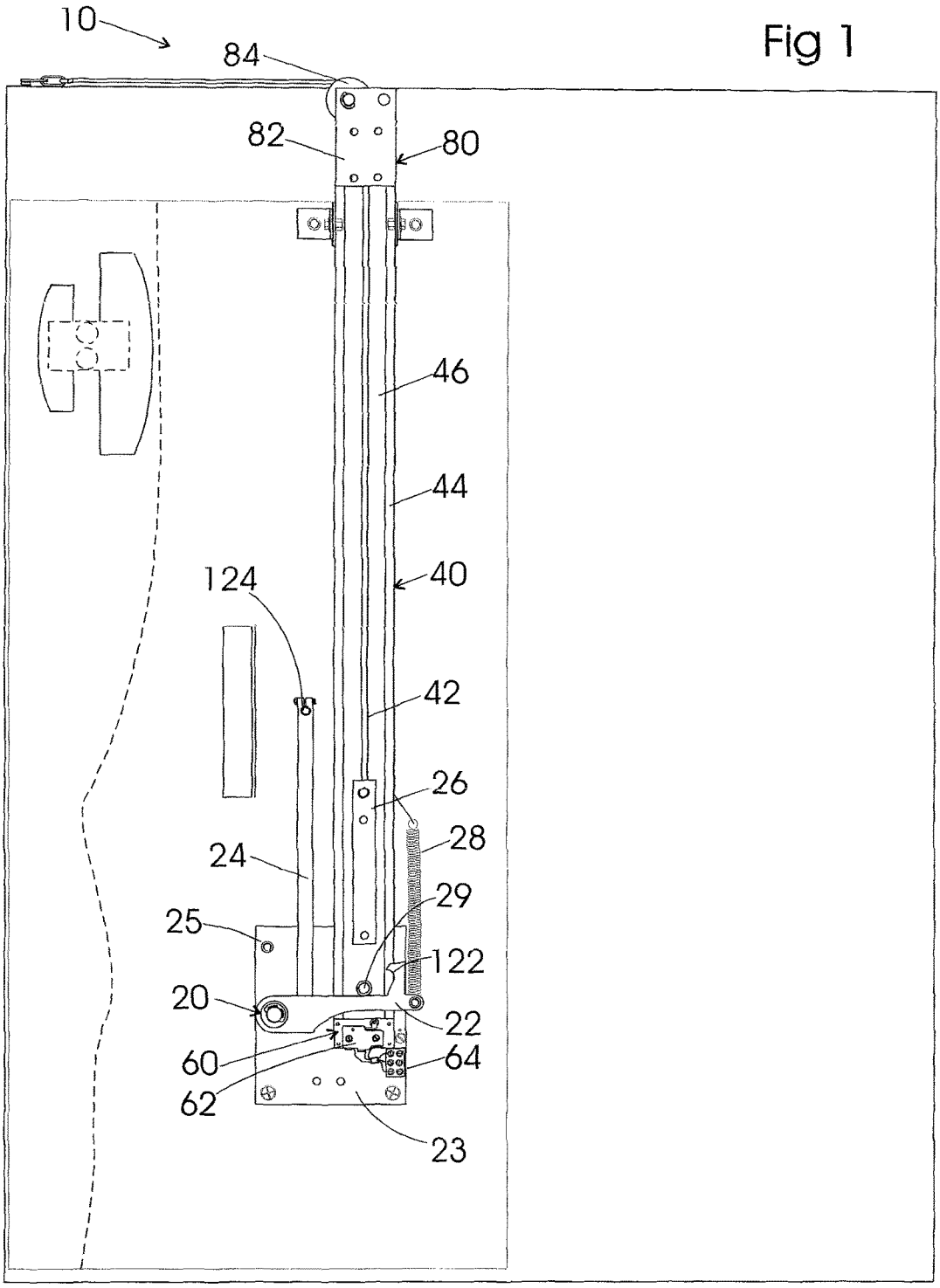
FIG. 1 represents an elevational view of an elevator door with the interlock assembly mounted thereon and the car being positioned in the traveling position.

Referring now to the drawings, where the present invention is generally referred to with numeral 10, it can be observed that it basically includes locking assembly 20, cable assembly 40, switch assembly 60, and top mounting assembly 80.

As seen in FIG. 1, locking assembly 20 includes hook 22, mounting plate 23, arm 24, stopper pin 25, weighted member 26 and elongated spring 28. As the elevator travels through the hoistway locking assembly 20 is in the starting position. The starting position includes arm 24 being in the substantially vertical position. Weighted member 26 includes locking pin 29. In the starting position, hook 22 is pushed down by the downward force weighted member 26 is applying to hook 22 through locking pin 29. Arm 24 is mounted to hook 22 so that when hook 22 is held down, arm 24 ends up being in the substantially vertical position. Hook 22 is mounted to mounting member 23. The interlock is mounted to the exterior of the inner elevator car door using mounting member 23 and top mounting assembly 80, described below. Mounting member 23 further includes stopper pin 25 mounted adjacent to arm 24. Stopper pin 25 serves to prevent hook 22 from rotating past a predetermined position that would allow weighted member 26 to reset the locking mechanism.

In emergency situations, after firemen open the elevator door, locking assembly 20 resets by itself. In an emergency situation where the door needs to be opened and there is no flag present, emergency personnel will open the door causing hook 22 to rotate upwards. The personnel will push arm 24 so that weighted member 26 can travel up channel 46 allowing the car door to open. Once emergency personnel releases arm 24, hook 22 will be biased to rotate upwards by spring 28 and block the path on channel 46 for weighted member to move to its initial position once the doors are closed. To solve this, hook 22 has a predetermined angle so that even when it is in the path of weighted member 26, hook 22 will coact with locking pin 29 in a manner for it to be moved out of the path, therefore, allowing locking assembly 20 to reset itself.

Figure 1C:
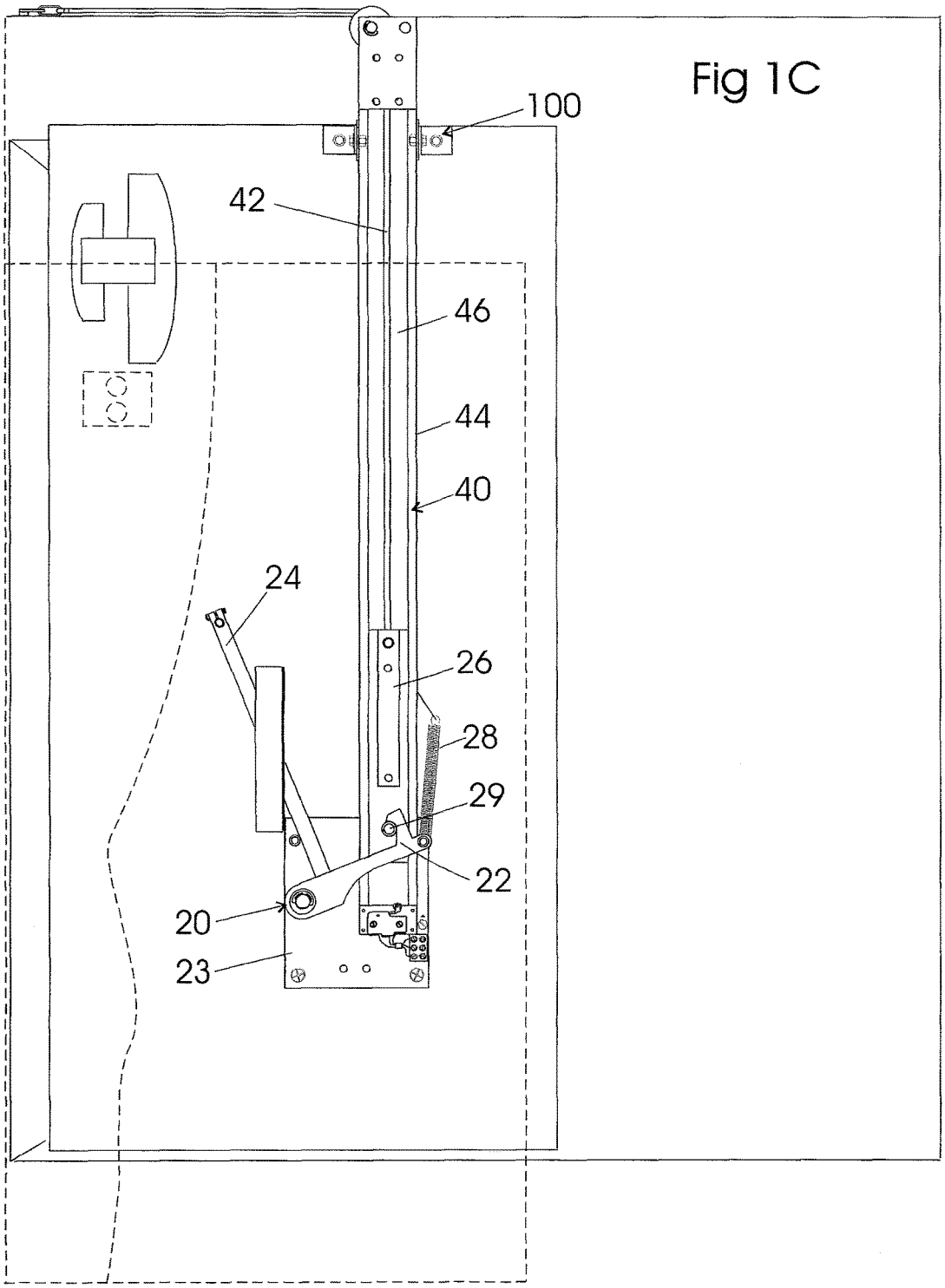
FIG. 1C shows an elevational view of an elevator door with the arm of the locking mechanism not engaging a flag, thereby allowing the hook to engage locking pin and preventing weighted member from traveling up the channel, thereby keeping the elevator doors locked.
Figure 2:
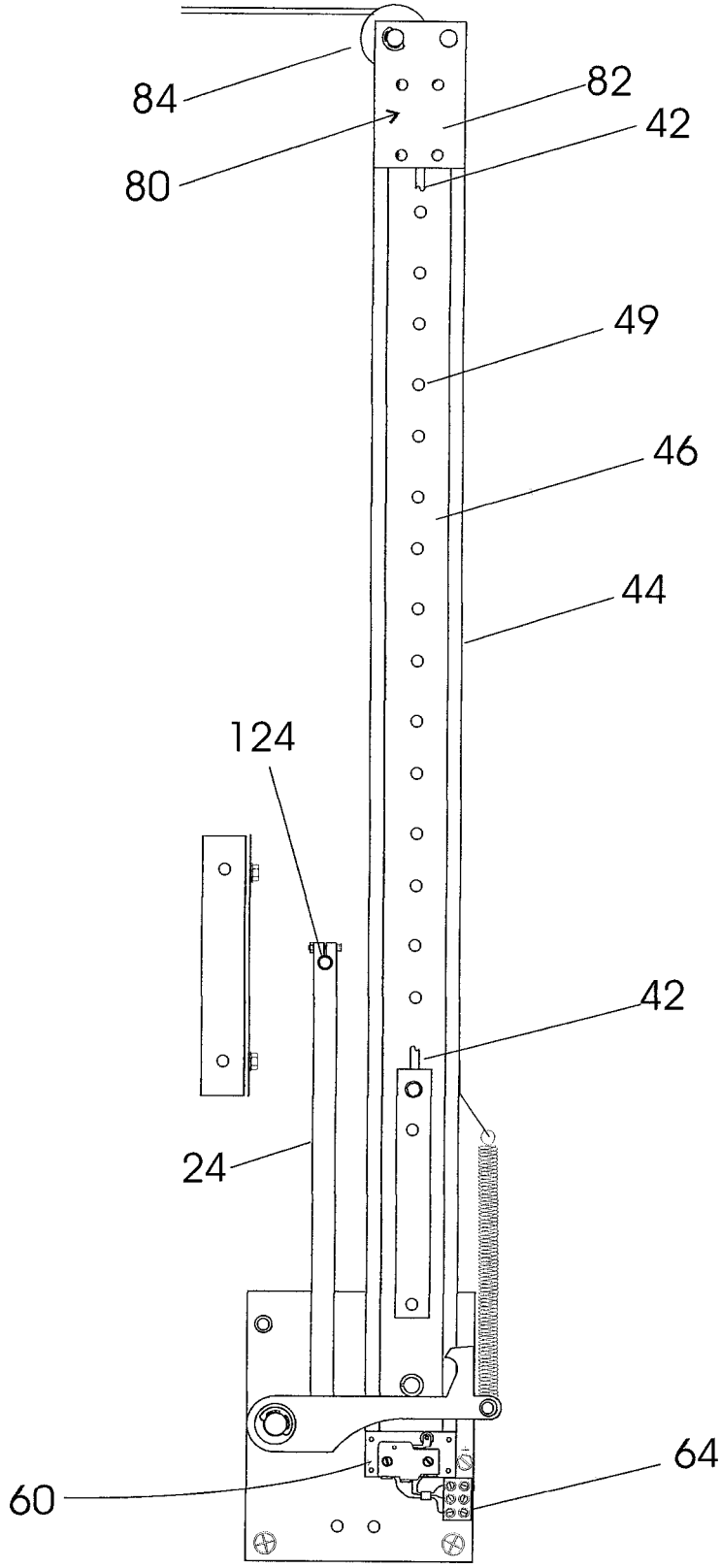
FIG. 2 shows a front elevational view of the car door interlock in the traveling position (with the door closed) showing a plurality of mounting holes along the shaft.
Figure 3:
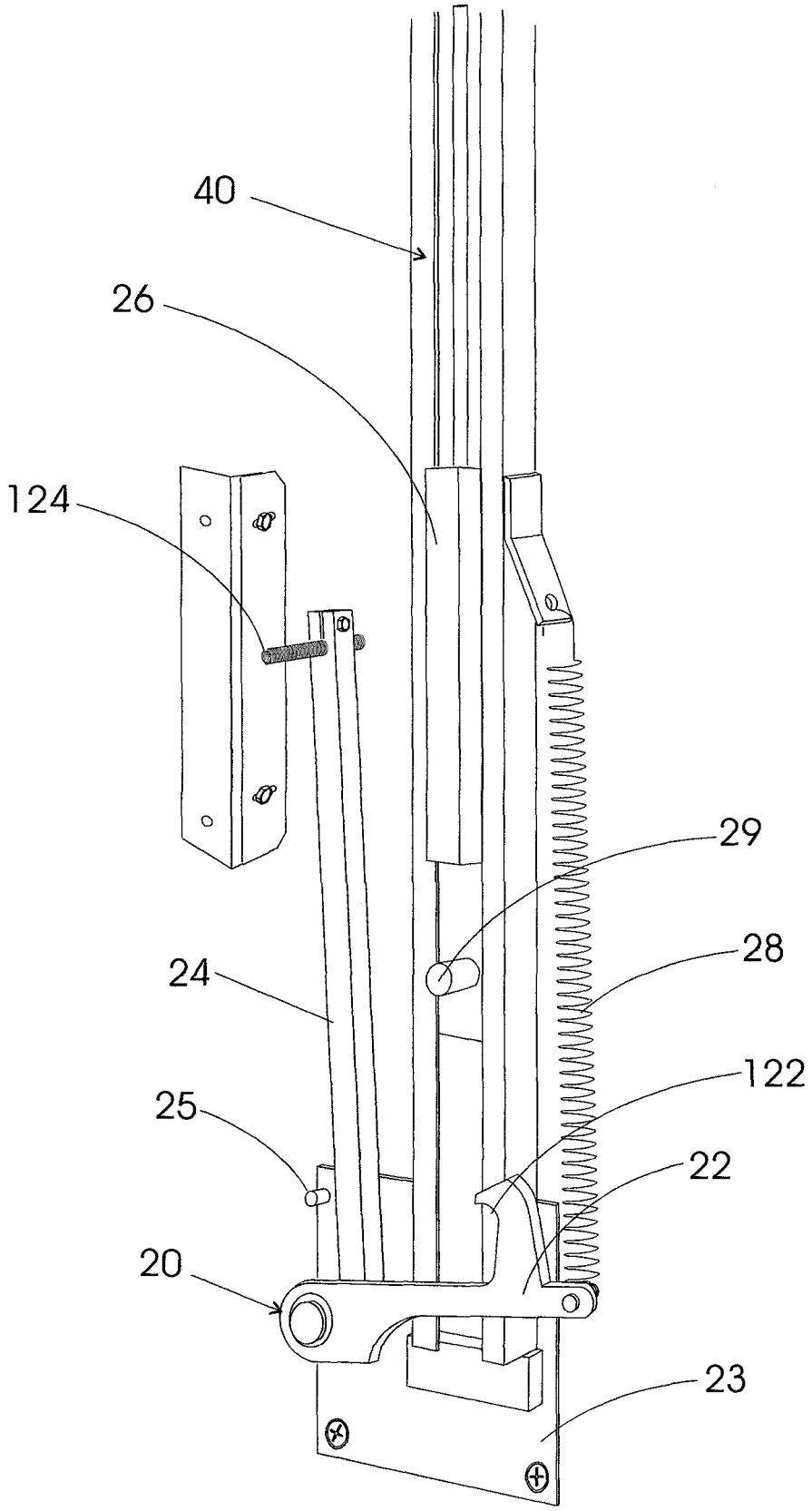
FIG. 3 illustrates an isometric view of the car door interlock without the switch and unlocked allowing the elevator door to open. Flag engagement member can be seen coming into abutting contact with a flag.
Figure 3A:
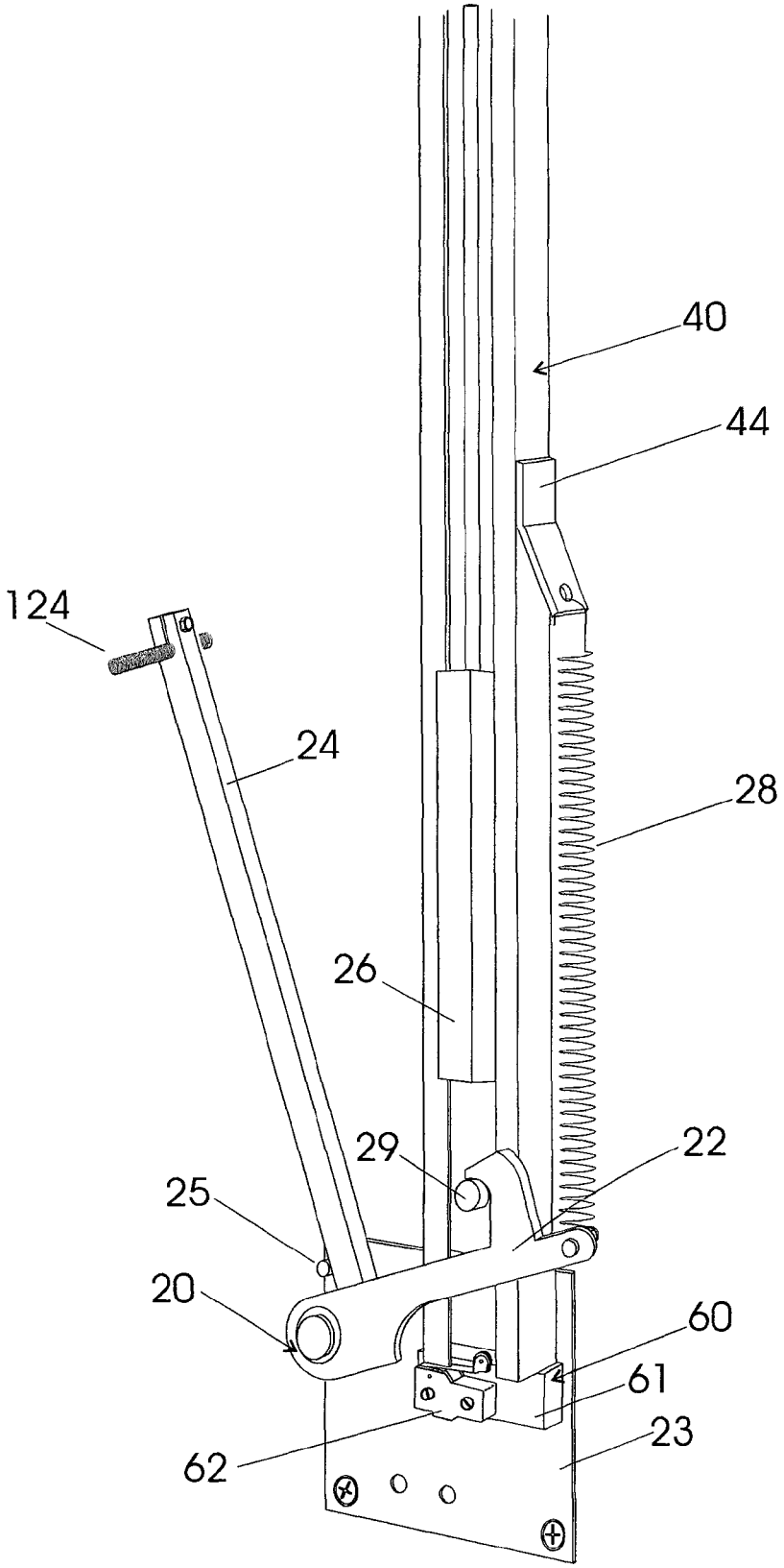
FIG. 3A shows an isometric view of the car door interlock with a switch and a hook stopping member in the locked position, thereby not allowing the elevator doors to open.
Figure 3B:
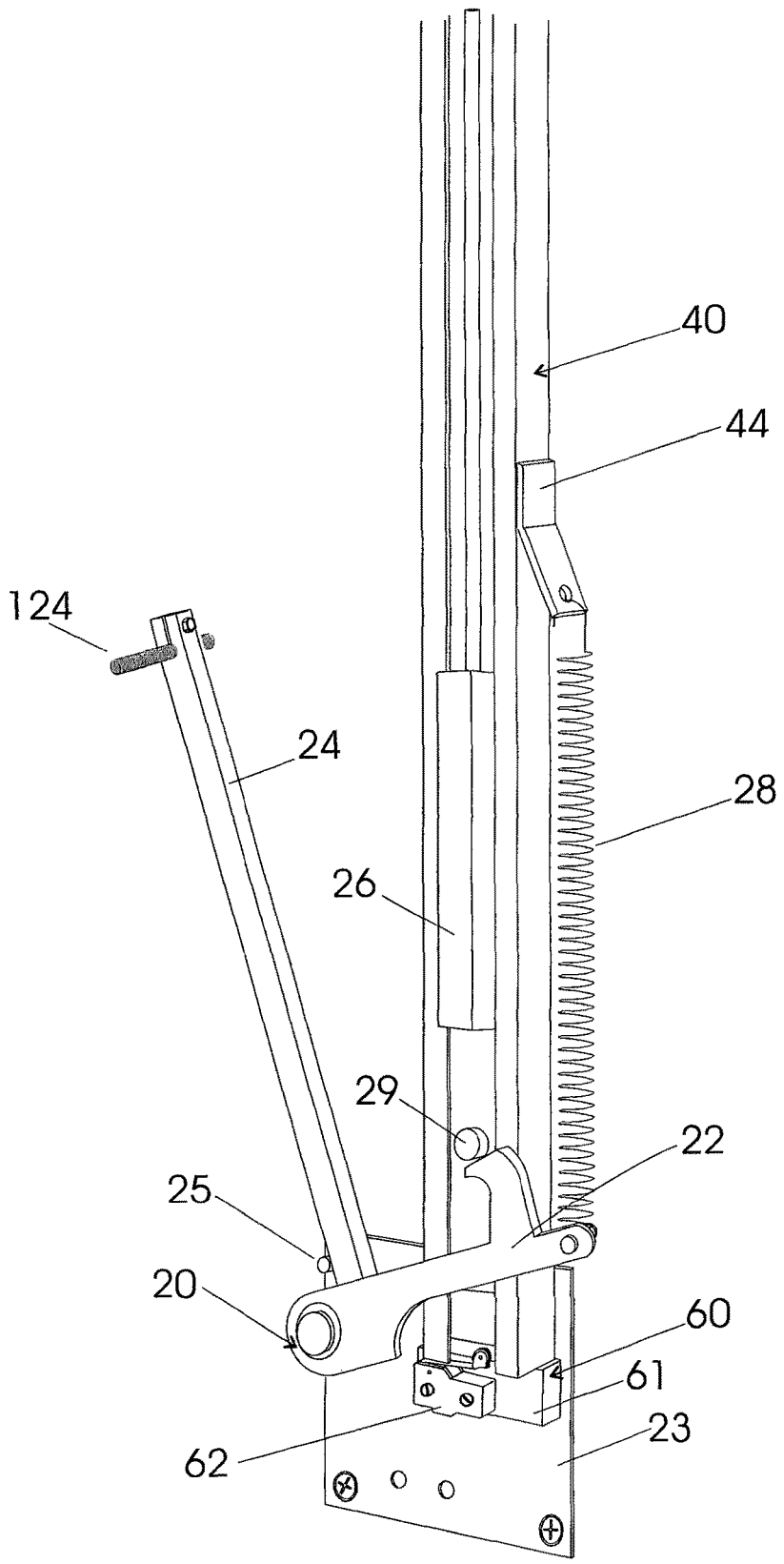
FIG. 3B shows the locking pin above the hook, the hook having a predetermined angle that allows the weighted member to traverse it as it resets itself into its initial position at the bottom of the channel and against the switch.
Figure 4:
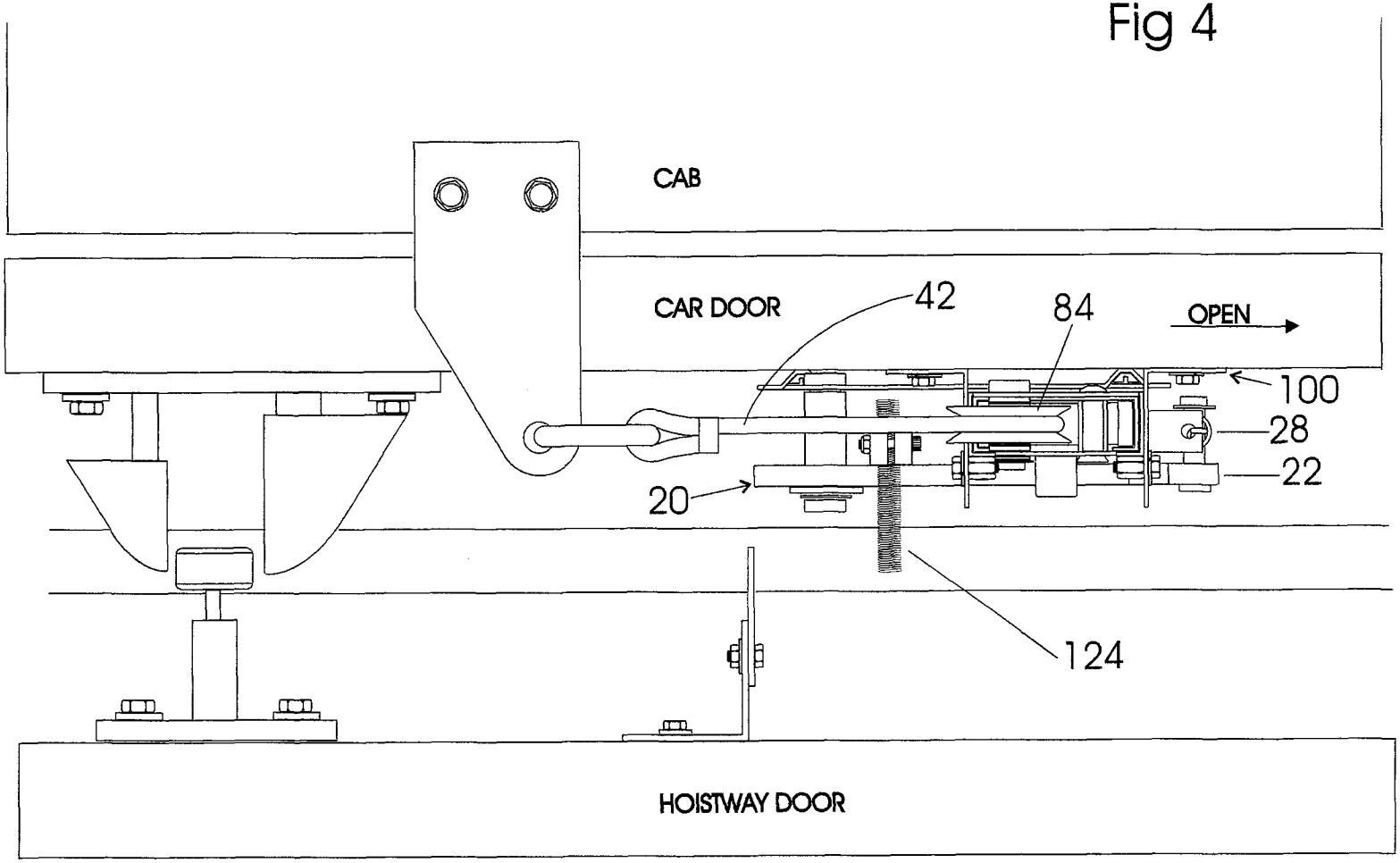
FIG. 4 is a representation of a top view showing the car door interlock mounted to the top of the elevator car wherein the car door has not been opened yet so the arm is still in its substantially vertical position.

Cable assembly 40 includes cable 42 which can made of Kevlar, steel or any similar material and is attached at the top end to the elevator car and at the bottom end to weighted member 26. Cable assembly 40 further includes shaft 44 that is made to at least the same length as the distance that the elevator car doors can open. In an alternate embodiment, shaft 44 includes a plurality of holes 49 which are used to mount the present invention to the elevator car door as seen in FIG. 2. Cable assembly 40 also includes channel 46 wherein cable 42 travels longitudinally. When the car door is attempted to be open within the locking area (where no flag is present) cable 42 pulls weighted member 26, including locking pin 29, upwards. As weighted member 26 begins to rise, there is no longer a downward force holding hook 22 down. This allows elongated spring 28, which is mounted to hook 22, to bias hook 22 upwards. Weighted member 26 and locking pin 29 are allowed to travel through channel 46 a predetermined distance before hook 22 engages locking pin 29, preventing weighted member 26 and locking pin 29 to further travel through channel 46. Hook 22 includes cavity 122. This predetermined distance that weighted member 26 and locking pin 29 are allowed to travel is determined by the distance between locking pin 29 and cavity 122 when locking assembly 20 is in the starting position. The predetermined distance is the distance that the elevator doors are allowed to open. For instance, if weighted member 26 and locking pin 29 are allowed to travel three inches before hook 22 engages locking pin 29, then the elevator door can be opened three inches within the locking area, as seen in FIG. 1C.

In the event of an emergency, authorized personnel can unlock locking assembly 20 within the locking area by manually tilting arm 24 back into the substantially vertical position, which pushes hook 22 down and overcomes the upward bias of elongated spring 28. This releases weighted member 26 and locking pin 29 to travel the extent of channel 46. The distance weighted member 26 and locking pin 29 are allowed to travel through channel 46 correlates to the distance that the elevator doors are allowed to open.

When the elevator is attempted to be open within an unlocking zone, the cable again pulls weighted member 26 and locking pin 29 upwards. This allows hook 22 to rise as it is biased upwards by spring 28. However, the unlocking zone is marked by the presence of a flag in the hoistway. Arm 24 includes flag engagement member 124 that can be adjusted to accommodate different distances to the flags. Flag engagement assembly 124 can be made of a flexible material to allow for a user to pull arm 24 past the flag. When the doors are attempted to be open within the unlocking zone, flag engagement member 124 engages the flag, as seen in FIG. 1B. The flag keeps arm 24 in the substantially vertical position and, consequently, hook 22 is kept in the lowered position. This releases weighted member 24 and locking pin 29 allowing cable 42 to travel the length of channel 46, thereby opening the elevator doors.

The length of the flag is made to a predetermined length that defines the allowable unlocking area. The unlocking area is generally defined by pertinent elevator code. For instance, if the unlocking area is desired to be four feet, then the flag needs to be four feet long so that flag engagement member 124 can engage the flag at any point within those four feet and allow the elevator car doors to open. The interlock subject of the present invention works by allowing the car doors to open where a flag is present. Therefore, as opposed to the prior art that require flags to keep the elevator doors locked, flags in the present invention are only necessary in the unlocking zones of the hoistway. This significantly reduces material and labor costs associated with the installation of the flags.

Further, the present invention is considered a car door interlock as opposed to only a car door restrictor because it employs the use of switch assembly 60 mounted to mounting member 23. As seen in FIGS. 1-2, switch assembly 60 includes hook stopping member 61, switch 62 and leads 64. Switch 62 is in abutting contact with bottom distal end of weight member 26. Switch maintains power to driving means while weighted member 26 is in abutting contact with it. Upon a user opening car doors, cable 42 lifts weighted member 26 off of switch assembly 60. This causes switch 62 to shut power off to the elevator's driving means.

Figure 5:
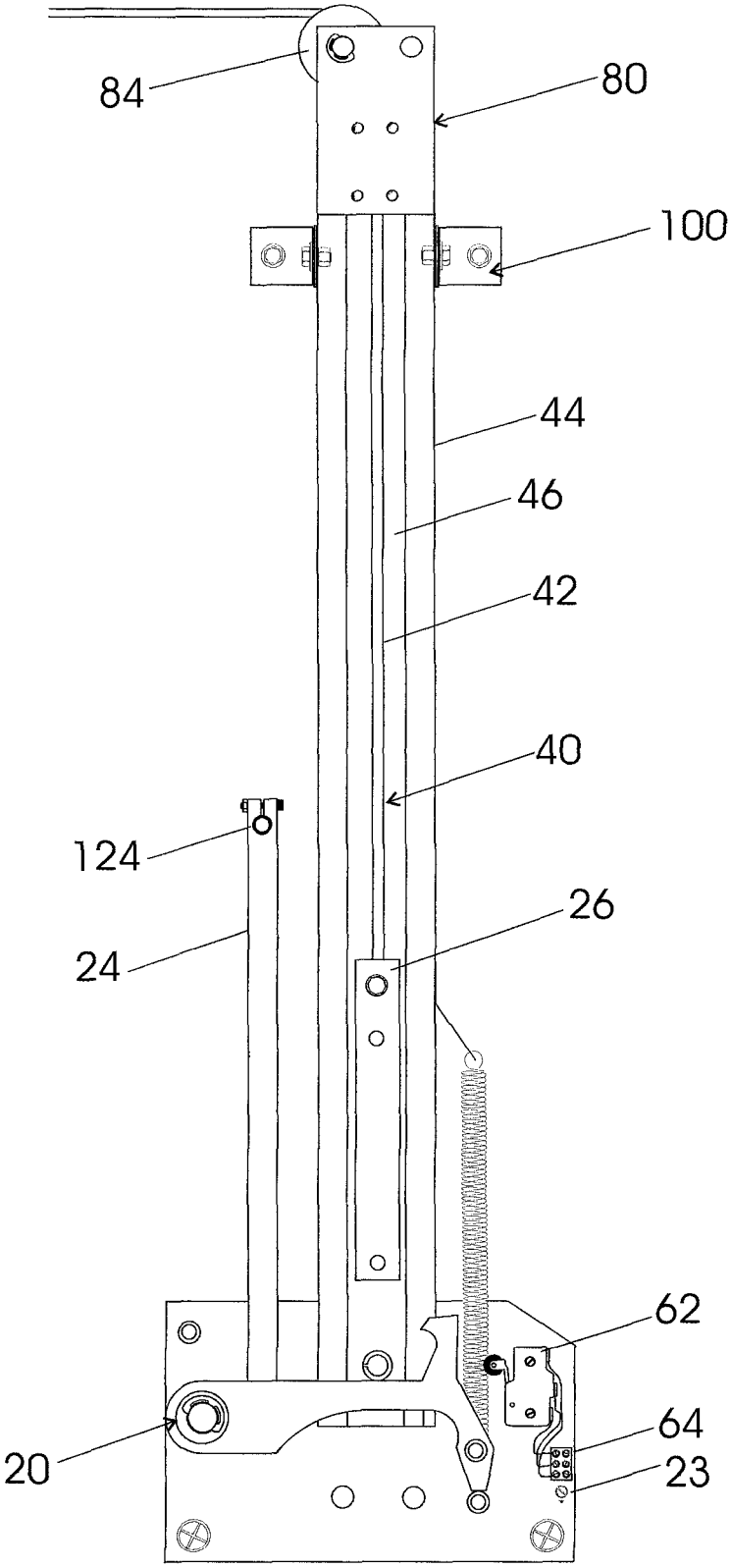
FIG. 5 shows a front elevational view of the elevator car door interlock in the traveling position with the switch mounted adjacent to the elongated spring member.
Figure 6:
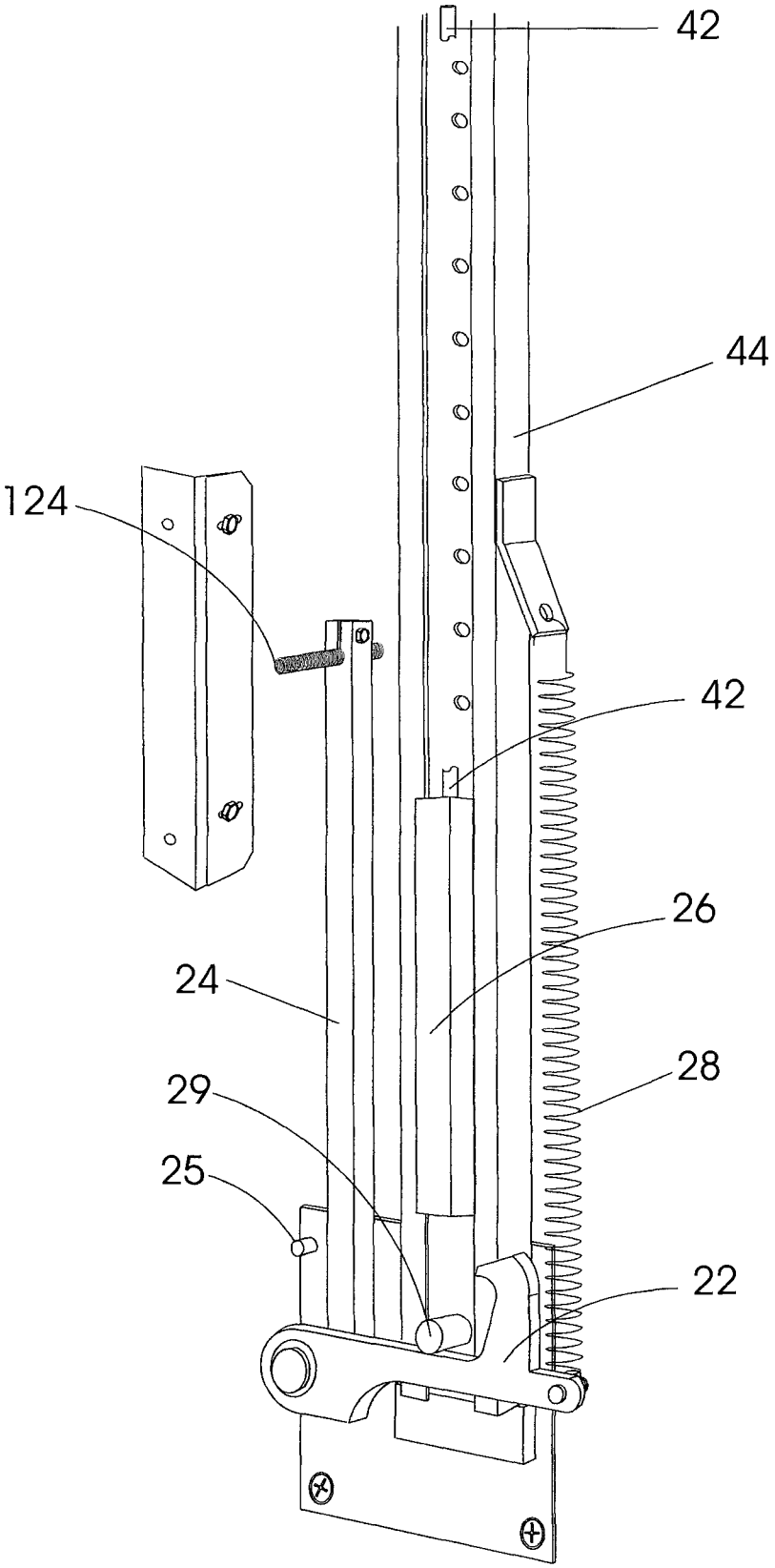
FIG. 6 is an isometric view showing the interlock in the travel position and stopping pin 25 to prevent hook 22 from rotating past the predetermined point.
Figure 6A:
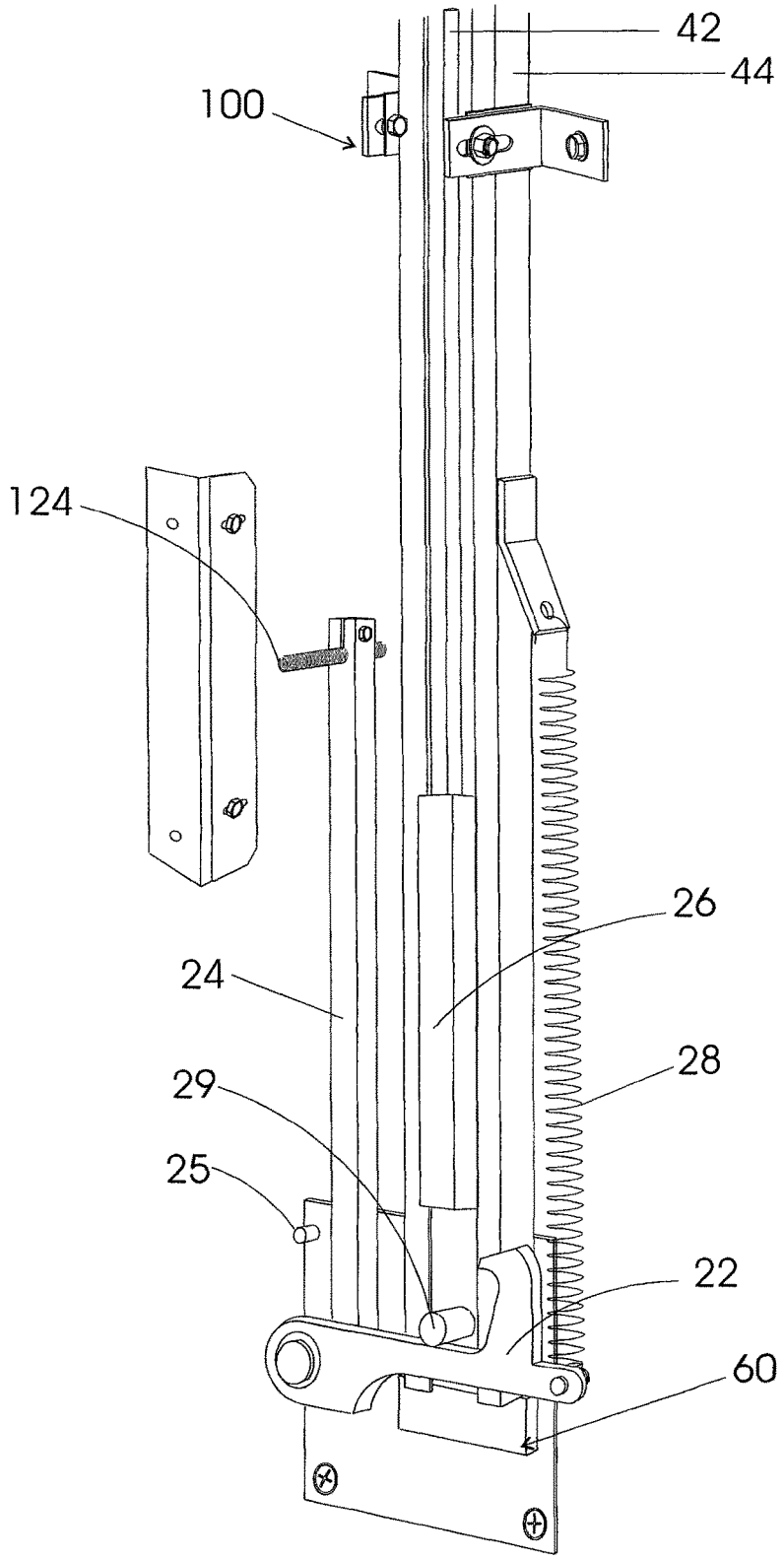
FIG. 6A illustrates the interlock in the traveling position and mounted using bracket assembly 100.
Figure 6B:
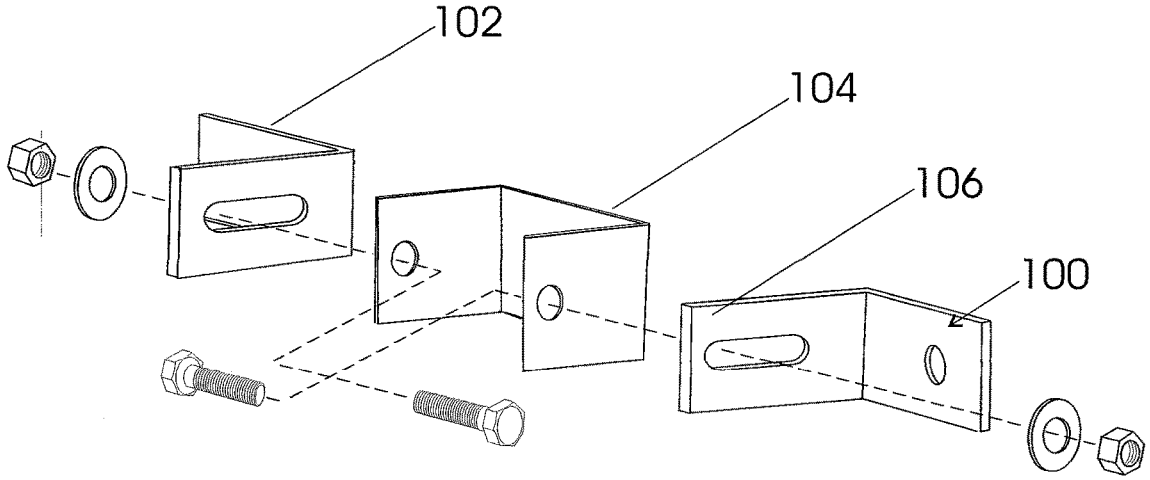
FIG. 6B shows bracket assembly 100 comprised of partial sleeve 104, and side brackets 102 and 106.

In an alternate embodiment, shown in FIG. 5, switch assembly 60 is mounted to mounting member 23 at a predetermined location wherein switch 62 is in front of elongated spring 28 and is activated upon hook 22 rising and coming in abutting contact with switch 62, whereupon power is then shut off to the elevator's driving means.

As seen in FIG. 1, top mounting assembly 80 includes top mounting plate 82 and pulley 84. The interlock is mounted to the exterior of the inner car door using mounting member 23 at the bottom and top mounting plate 82 at the top. If the elevator uses a right-handed door, pulley 84 is mounted on the right side of top mounting plate 82. If it is a left-handed door, pulley 84 is mounted to the left side of top mounting plate 82. Optionally, as shown in FIG. 1A, in the event obstructions are in the path of cable 42 between channel 46 and the mounting point on the elevator car inner door mounting assembly 100 can be used to create space between the car door and the interlock so that cable 42 has space to find a more practical mounting point.

In an alternate embodiment, where elevator interlock is mounted so that a portion is above the elevator car door, mounting assembly 100 is used to angle and support shaft 44 so it can be pitched to clear any obstructions.

Figure 1A:
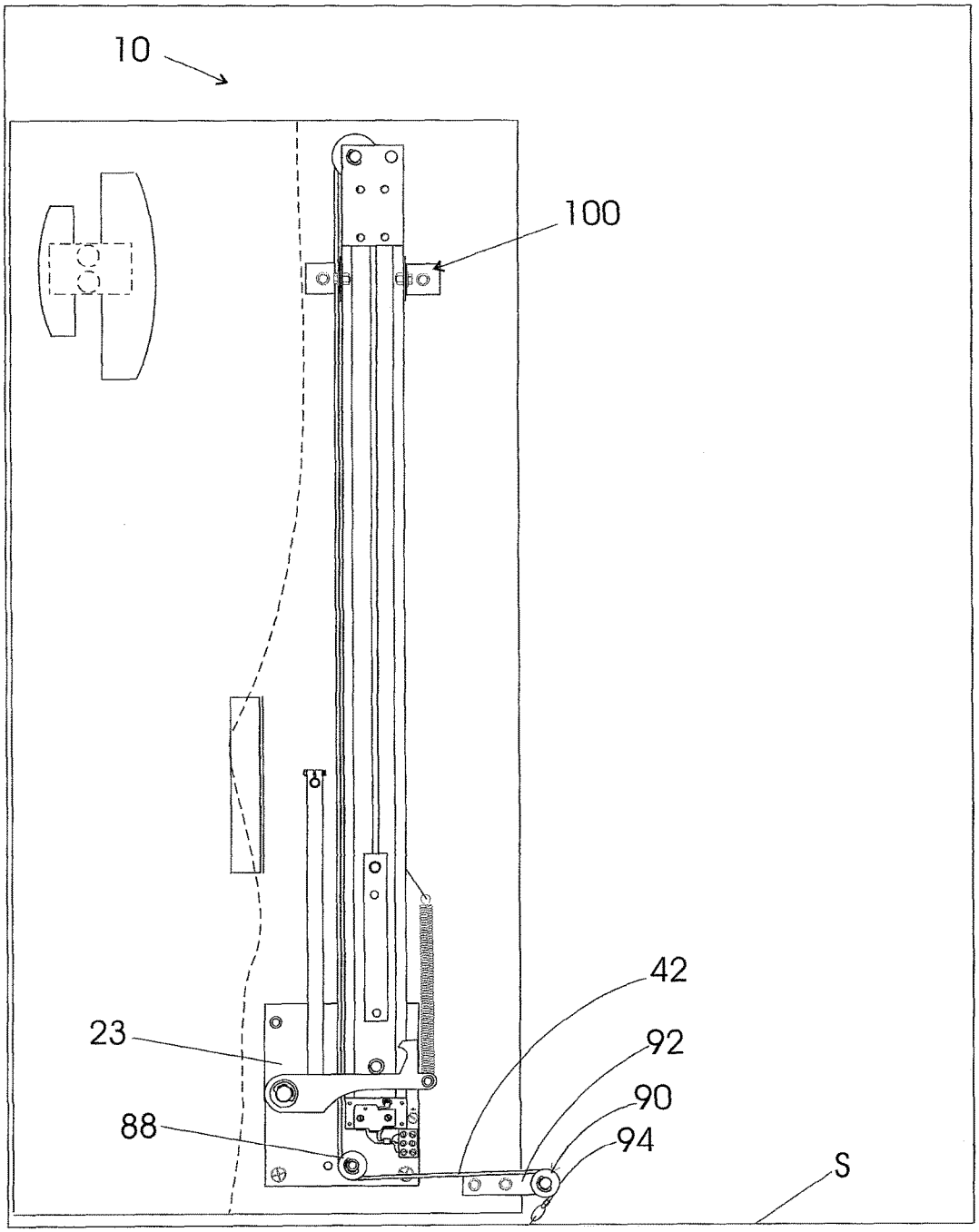
FIG. 1A shows an elevational view of an elevator door in the traveling position and the cable of the locking mechanism is mounted to the bottom of the elevator car.
Figure 1B:
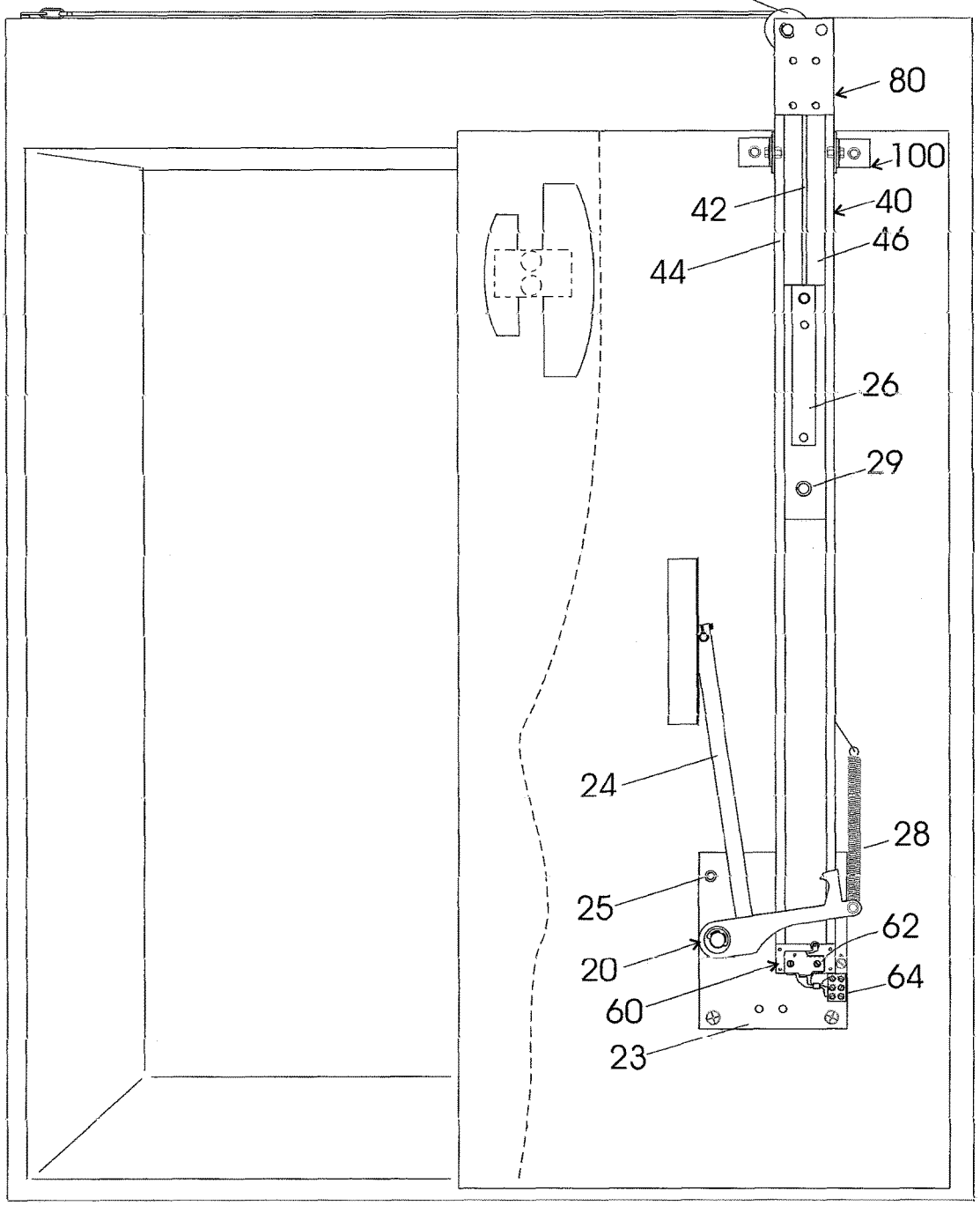
FIG. 1B illustrates an elevational view of an elevator door with the arm of the locking mechanism coming into abutting contact with a flag, thereby preventing hook from engaging the locking pin, and allowing the weighted member to travel up the shaft and open the elevator car doors.

As seen in FIG. 1A, if there are too many obstructions to make mounting cable 42 to the top of the elevator car feasible, an alternate embodiment can be used, wherein cable 42 can be redirected to bottom pulley 88 on mounting member 23. From bottom pulley 88 cable 42 runs to deflecting assembly 90. Deflecting assembly 90 includes cable deflecting member 92 and deflecting pulley 94. Cable deflecting member 92 mounts deflecting assembly 90 to the car door. Cable 42 passes through deflecting pulley 94 and then is mounted to car door sill. In an alternate embodiment, cable deflecting assembly 90 can be used on the top of the interlock to find a more practical mounting point at the top of the elevator car door.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An elevator car door interlock, comprising:

a. an elongated shaft, b. a cable, having first end mounted to an elevator car that includes a car door and second end mounted to a weighted member, said weighted member includes a pin, said cable is pulled upwards when a user opens the car door of said elevator car a distance substantially equivalent to the distance that said car door is opened, c. means for mounting said shaft to said elevator car, d. a locking mechanism having a hook, e. said locking mechanism includes a spring having first end mounted to said shaft and having second end mounted to said hook, said hook is biased upwards by said spring, said hook is pushed down by said pin with sufficient force to overcome the bias of said spring, f. an elongated arm mounted to said hook having a flag engagement member at its distal end that engages a flag along an unlocking area of a hoistway, whereby when the user attempts to open said car door, said cable will rise allowing said bias of said spring to pull said hook upwards and engage said pin, preventing said car door from opening further.

2. The car door interlock in claim 1 wherein said hook is a predetermined dimension that cooperates to engage said pin at a predetermined distance along said elongated shaft when said car door is opened.

3. The car door interlock in claim 1 wherein said cable passes through at least one pulley mechanism to direct said cable to a mounting point on said elevator car.

4. The car door interlock in claim 1 wherein said shaft includes a channel where said cable and said weighted member travel through.

5. The car door interlock in claim 1 wherein said cable is made of a rigid material.

6. The car door interlock in claim 1 wherein said cable is made of a fiber rope material.

7. The locking mechanism in claim 1 wherein said hook is prevented from being lowered past a predetermined distance by a stopper pin.

8. An interlock assembly for an elevator system comprising:

a) a structure having a vertical hoistway including at least two landings;

b) a flag for each of said landings and mounted at predetermined locations in said structure;

c) a car movable within said hoistway and said car including a horizontal sliding door; and d) a mechanism for releasably locking said door mounted to said car and cooperatively actuated by one said flags when said car is in registration with said landings to release said locking mechanism and permit said door to slide;

e. said mechanism allows said door to slide a predetermined distance when not actuated by said flags; and f. said mechanism includes a vertical disposed channel member mounted to said door having first and second ends, and including a weight carriage slidably mounted within said channel, a cable with two ends, one cable end mounted to said carriage, said cable being in contact with a diverting member to cause said cable to extend substantially horizontally with the other end mounted to a fixed location in said door so that when said door slidingly moves said carriage also moves and further including a latch assembly for preventing said carriage from moving beyond said predetermined distance unless said latch assembly is actuated by one of said flags.

9. The interlock assembly set forth in claim 8 wherein said mechanism includes brackets mounted to the top end of said vertically disposed channel member to create space between the interlock and said door.

10. The interlock assembly set forth in claim 8 wherein said mechanism includes a switch that shuts off power to the driving means of said car upon the activation of said locking mechanism, said switch includes a hook stopping member to prevent said hook from rotating past a predetermined point.

11. The interlock system set forth in claim 8 wherein a hook is of a predetermined angle to allow said weighted carriage to push past said hook and return to its initial resting position.

12. The interlock system set forth in claim 8 wherein a flag engagement member is made of a flexible material.

* * * * *